US005372028A

United States Patent [19]

Brilman et al.

[11] Patent Number: 5,372,028

[45] Date of Patent: Dec. 13, 1994

[54] DEVICE FOR FORMING A CONSTRUCTION ON THE OPEN END ZONE OF A METAL CAN

[75] Inventors: Gerrit W. Brilman, Bathmen; Johan W. Roeterdink, Epse, both of Netherlands

[73] Assignee: Thomassen & Drijver-Verblifa N.V., Deventer, Netherlands

[21] Appl. No.: 147,426

[22] Filed: Nov. 5, 1993

Related U.S. Application Data

[63] Continuation of Ser. No. 855,853, Mar. 20, 1992, abandoned.

[30] Foreign Application Priority Data

Apr. 3, 1991 [NL] Netherlands ..... 9100574
Apr. 9, 1991 [NL] Netherlands ..... 9101493

[51] Int. Cl.[5] ..... B21D 3/04
[52] U.S. Cl. ..... 72/117; 72/113
[58] Field of Search ..... 72/117, 113, 115, 105, 72/102, 379.4, 370, 91, 92, 120, 121, 122

[56] References Cited

U.S. PATENT DOCUMENTS

| | | | |
|---|---|---|---|
| 743,644 | 11/1903 | Johnson | 72/117 |
| 1,798,742 | 3/1931 | Kellogg | 72/117 |
| 1,842,447 | 1/1932 | Dister . | |
| 2,355,852 | 8/1944 | Fisher | 72/117 |
| 3,260,088 | 7/1966 | Gruetter et al. | 72/115 |
| 3,688,538 | 9/1972 | Hoyne | 72/46 |
| 3,754,424 | 8/1973 | Costanzo | 72/105 |
| 3,898,828 | 8/1975 | Cassai | 72/117 |
| 4,308,737 | 1/1982 | Kanegiesser et al. | 72/105 |
| 4,341,103 | 7/1982 | Escallon et al. | 72/105 |
| 4,450,700 | 5/1984 | Robertson | 72/115 |

FOREIGN PATENT DOCUMENTS

| | | | |
|---|---|---|---|
| 2440789 | 6/1980 | France . | |
| 0841750 | 6/1981 | U.S.S.R. | 72/113 |

*Primary Examiner*—Daniel C. Crane
*Attorney, Agent, or Firm*—Watson, Cole, Grindle & Watson

[57] ABSTRACT

A device for forming a constriction at an open end portion of a metal can having a cylindrical body includes:

(1) a support member for supporting the bottom of a can and for pushing displacement thereof in an axial direction;

(2) an annular anvil placed coaxially of this support member, on the side of which facing the support member an internal modeling surface is present which in the direction away from the support member has a form adapted to the desired shape of the constriction; and (3) a freely-rotating roller having a form adapted to the shape of the modeling surface, which roller can press the end portion of a positioned can forcefully against the modeling surface, which roller is carried by a support member which is driven in a circular path concentric to the annular modeling surface, wherein the axis of rotation of the freely-rotating roller extends at least approximately in the the axial direction.

6 Claims, 3 Drawing Sheets

DEVICE FOR FORMING A CONSTRUCTION ON THE OPEN END ZONE OF A METAL CAN

CROSS-REFERENCE TO RELATED APPLICATION

The present application is a continuation of application Ser. No. 855,853, filed Mar. 20, 1992, now abandoned.

BACKGROUND AND SUMMARY OF THE INVENTION

This invention relates to an operation having the object of providing the open mouth zone of a metal can with a constricted end portion.

For this purpose the invention provides a device for forming a constriction on the open end zone of a metal can with a cylindrical body, comprising:

(1) a support member for supporting the bottom of a can and pushing displacement thereof in axial direction;

(2) an annular anvil placed coaxially of this support member, on the side of which facing the support member an internal modelling surface is present which in the direction away from the support member has a form adapted to the desired shape of the constriction; and (3) a freely-rotating roller having a form adapted to the shape of the modelling surface, which roller can press the end zone of a positioned can forcefully against the modelling surface, which roller is carried by a support member which is driven by drive means in a circular path concentric to the annular modelling surface, wherein the axis of rotation of the freely-rotating roller extends at least approximately in the axial direction.

During use of the device a rolling operation takes place wherein the can for processing is positioned relative to the annular anvil such that the end rim of the can comes to lie against the anvil. The end rim of the can is subsequently pressed forcibly against the anvil by a fully peripheral rolling operation by means of the freely-rotating roller. The shapes of the anvil and the freely-rotating roller are mutually adapted and correspond with the shape of the constriction to be obtained.

A gradual shifting of the can in axial direction takes place during the operation.

The operation is terminated at the moment when the constriction has reached the desired length. The shape is determined by the form of the anvil and the freely-rotating roller.

The freely-rotating roller can have a rotational centre line with the same direction as that of the can. The device can however advantageously have the feature that the rotational axis of the freely-rotating roller lies in a tangential plane and forms a small angle with the axial direction. A very effective ironing is achieved herewith and the material "seeks" a path between the ring and the roller. Thus achieved is that minimal axial forces are exerted on the can wall.

A particular embodiment has the feature that the angle has a value in the order of magnitude of 0.5°.

In a practical embodiment the bearing construction for the freely-rotating roller revolves with respect to the fixedly disposed can. This permits a very simple construction. It will be apparent that the complementary arrangement is also possible. What is important here is the relative movement of the roller relative to the can.

The roller and the anvil must be very hard. For an acceptable stand-time use can for instance be made of hard-metal or another material with a very high wear resistance and hardness.

A certain flexibility in the construction can be useful in order to properly position the co-acting surfaces relative to one another under all conditions. Excessive rigidity in the construction can result in extremely great forces which could have an adverse effect on the useful life of the device.

BRIEF DESCRIPTION OF THE DRAWINGS

The annexed drawings depict a device according to the invention. In the drawings.

DETAILED DESCRIPTION OF THE PREFERRED EMBODIMENT

Figure 1:
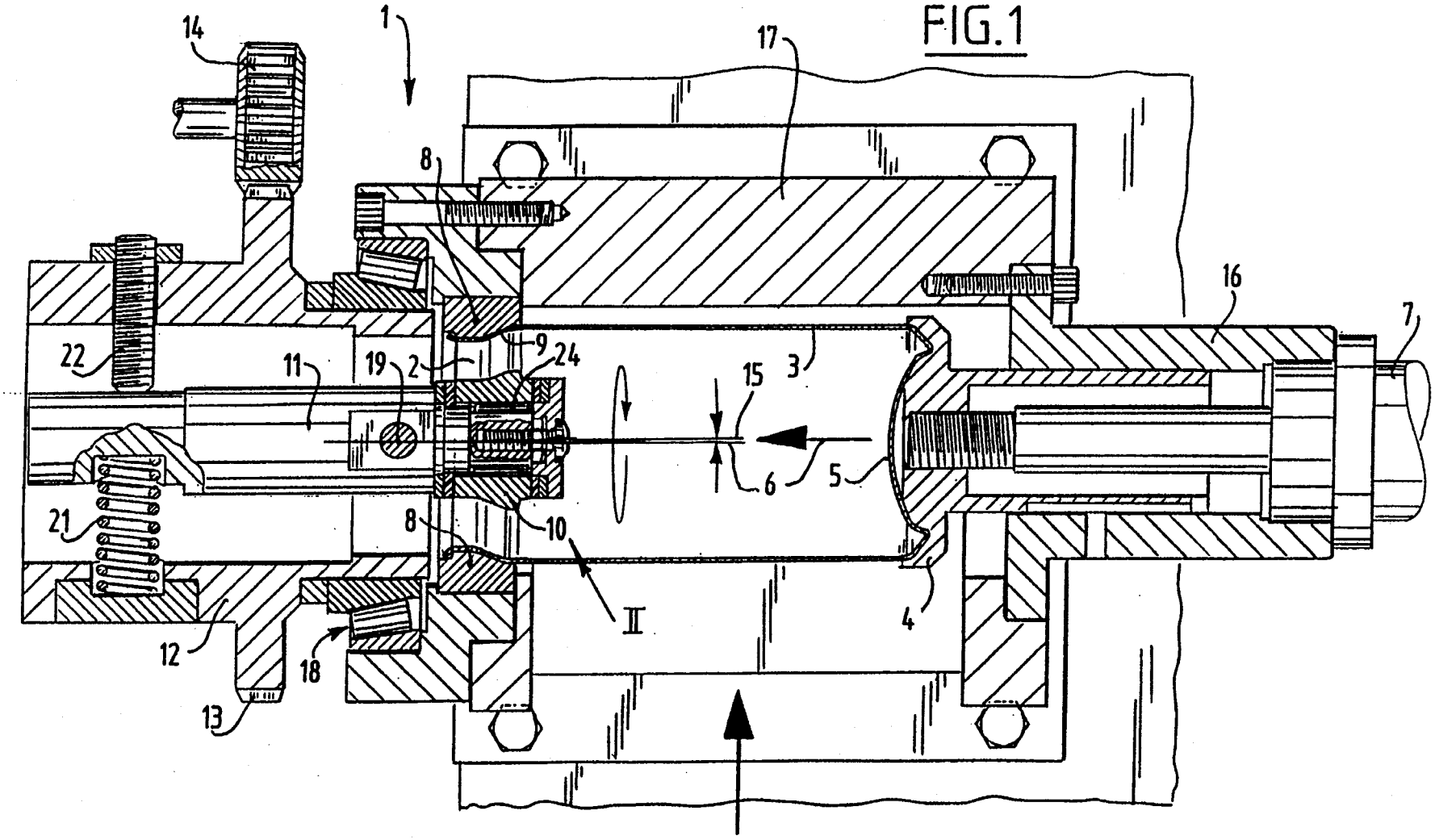
FIG. 1 shows a cross sectional view of a device according to the invention.
Figure 2:
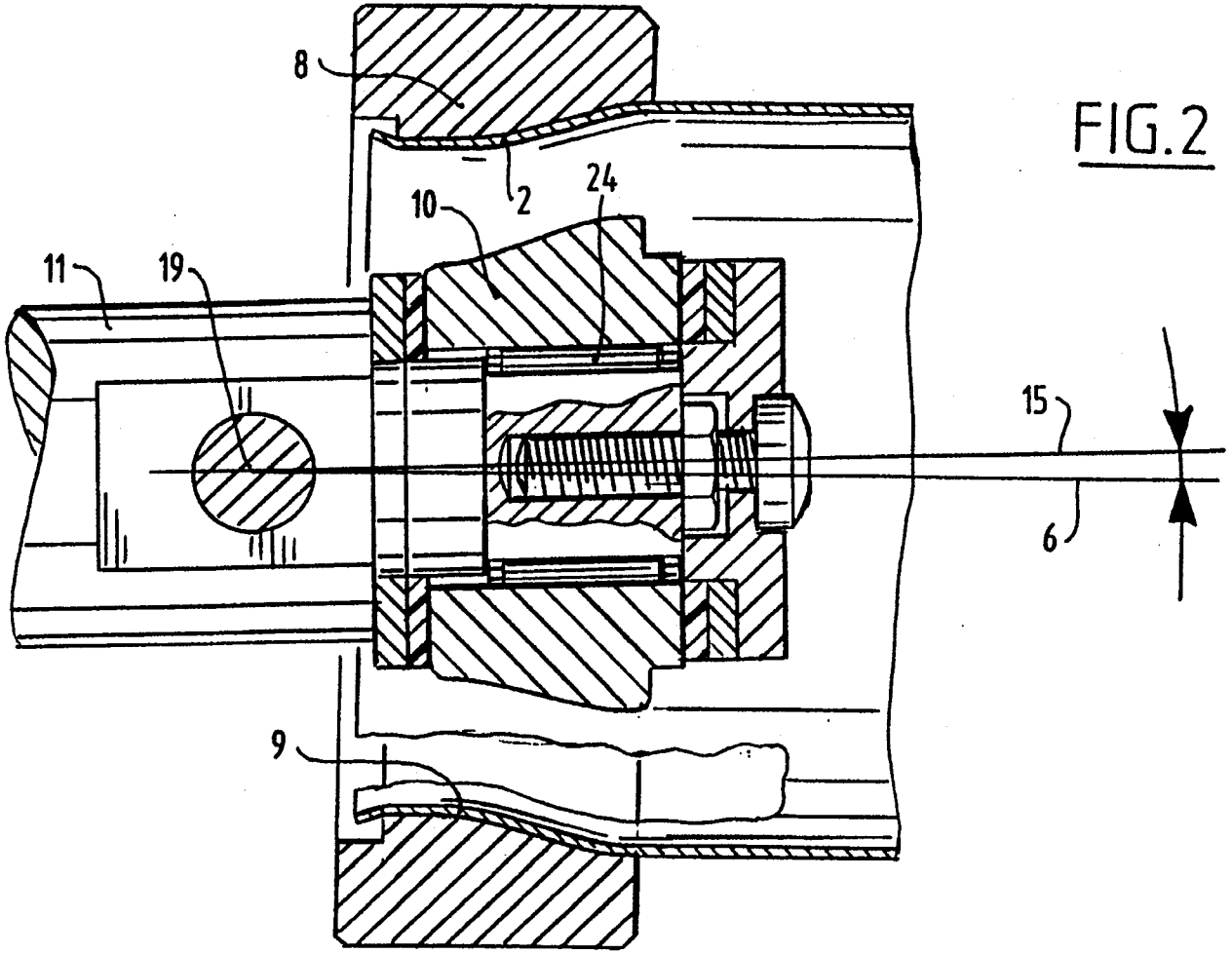
FIG. 2 shows on enlarged scale the detail II in FIG. 1.

FIGS. 1 and 2 show a device 1 for forming a constriction 2 on the open end zone of a metal can 3 with a cylindrical body, which device comprises:

- a support member 4 for supporting the bottom 5 of the can 3 and for pushing displacement thereof in axial direction 6 by means of a pushing member 7 which is controlled in suitable manner by a control unit (not shown);
- an annular anvil 8 placed coaxially of this support member 4, on the inner side of which facing the support member 4 an internal modelling surface 9 is present which in the direction away from the support member 4 has a form adapted to the desired shape of the constriction 2; and
- a freely-rotating roller 10 likewise having a form adapted to that of the desired constriction 2 and therefore to the shape of the modelling surface 9, which roller 10 can press the end zone of the positioned can 3 forcefully against the modelling surface 9, which roller 10 is carried by a support member 11 which forms part of a rotor 12 with an externally placed pinion 13 that co-acts with a drive gear wheel 14 which is connected to a drive motor (not drawn) such that the rotor 12 can thereby be set into a rotating movement, wherein the freely-rotating roller 10 is driven in a circular path concentric to the annular modelling surface 9, wherein the axis of rotation 15 extends at least approximately in the axial direction 6.

The support member 4 is guided slidably in axial direction in a cylinder block 16 which forms part of a frame 17 in which the anvil ring is clamped and to which the rotor 12 is rotatably connected by means of a bearing unit 18.

The support member 11 is pivotally connected via a pivot shaft 19 to the rotor 12. The views according to FIGS. 1 and 2 should be understood such that in the situation shown therein the freely-rotating roller 10 engages forcibly in a direction containing at least a considerable radial component. The rotational sense of rotor 12 is indicated by 20.

The axis of rotation 15 of the freely-rotating roller 10 lies substantially in a tangential plane and forms an angle of roughly 0.5° with the axial direction 6. FIGS. 1 and 2 show this angle in a somewhat exaggerated manner for the sake of clarity. In order to obtain a correct angle the rotor 12 is supported on one side by a pressure spring 21 and is placed in a sloping position counter to the action of the pressure spring by means of an adjusting screw 22 protruding outside the rotor 12. The freely-rotating roller 10 is supported rotatably by the support member 11 by means of a roller bearing 24.

Figure 4:
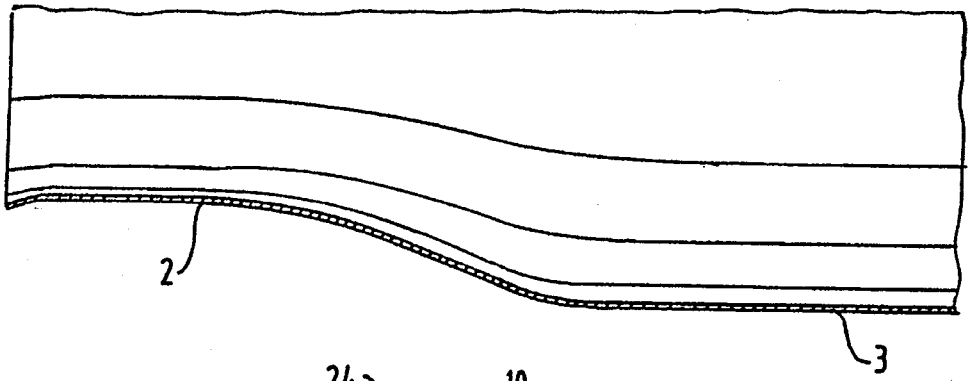
FIG. 4 shows a detail of an end wall of a can after processing by the device according to the invention.
Figure 3:
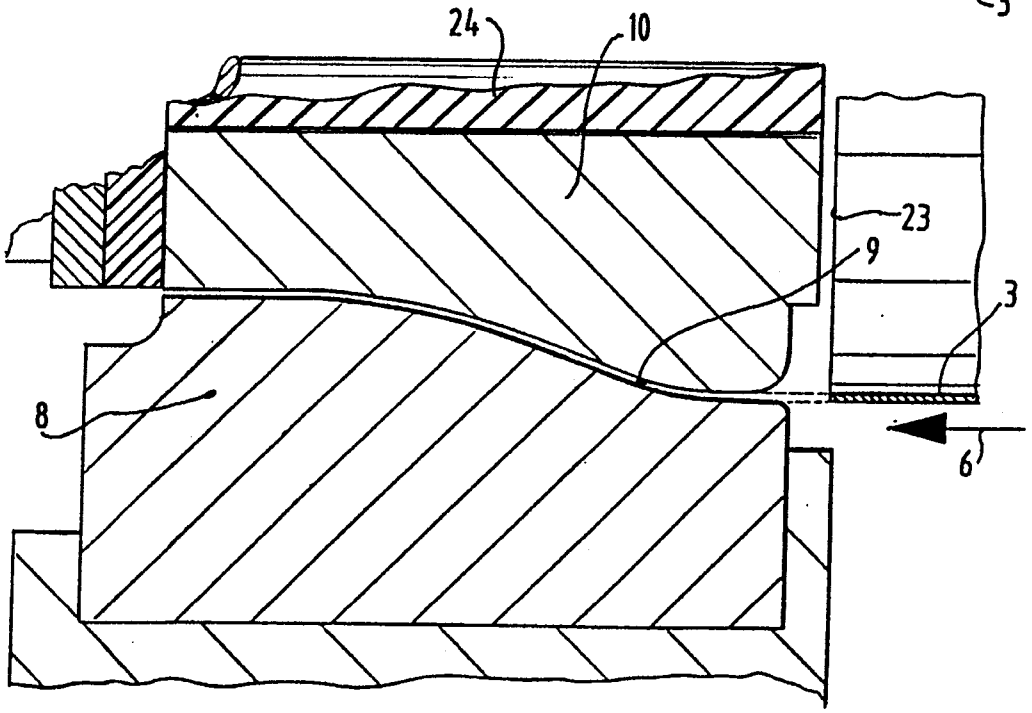
FIG. 3 shows a cross section through the anvil and the freely-rotating roller in the situation where a modelling operation is about to take place.
Figure 5:
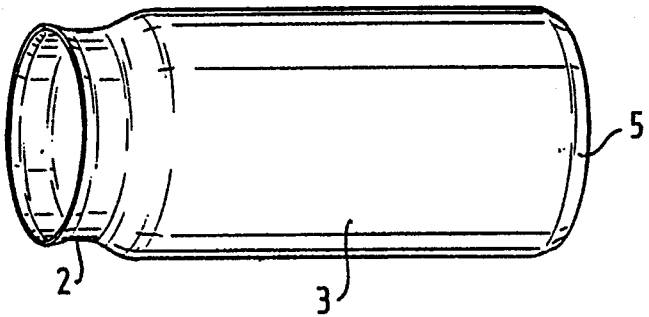
FIG. 5 is a perspective view of a can provided with a constriction by the device according to FIG. 1.

FIG. 3 shows the co-acting shapes of the modelling surface 9 of the anvil 8 and the roller 10. In the situation shown in FIG. 3, a can 3 is introduced into the transition zone between the anvil 8 and roller 10. Due to the rolling movement of roller 10 over the annular inner surface of the anvil 8, the can is pulled inward with its open end zone 23, whereby the constriction 2 is formed, as is shown in FIG. 4.

We claim:

1. An apparatus for forming a constriction in an open end portion of a metal can that includes a cylindrical side wall, a bottom wall and an open end portion opposite the bottom wall, said apparatus comprising:

a first support means for supporting the bottom wall of said can and for moving said can along an axis defined by said first support means, an annular anvil which is positioned coaxially of said axis and which provides an internal modeling surface that corresponds to a desired shape of said constriction, a free-rotating roller which is positioned within said annular anvil and which defines a rotational axis, said roller having an external shape which corresponds with said internal modeling surface, a second support means for mounting said free-rotating roller, and drive means for moving said second support means and freely-rotating roller in a circular path concentrically within said annular anvil such that said freely-rotating roller presses said open end portion of a can against said internal modeling surface of said annular anvil as said second support means and freely-rotating roller are moved in said circular path, said second support means mounting said freely-rotating roller such that said rotational axis lies in an imaginary plane tangent to said concentric circular path and extends at a small angle to a line parallel with said axis.

2. An apparatus as claimed in claim 1, wherein said small angle is about 0.5°.

3. An apparatus as claimed in claim 1, including a pivot shaft about which said second support means is pivotable to adjust said small angle.

4. An apparatus as claimed in claim 3, including means for pivoting said second support means about said pivot shaft.

5. An apparatus as claimed in claim 4, wherein said means for pivoting said second support means about said pivot shaft comprises a spring pressing against one side of said second support means and an adjustment screw contacting an opposite second side of said second support means.

6. An apparatus as claimed in claim 5, wherein said spring is a coil spring.

* * * * *

UNITED STATES PATENT AND TRADEMARK OFFICE

CERTIFICATE OF CORRECTION

PATENT NO. : 5,372,028

DATED : December 13, 1994

INVENTOR(S) : Gerrit W. BRILMAN et al.

It is certified that error appears in the above-identified patent and that said Letters Patent is hereby corrected as shown below:

On the title page, item:

[30] Foreign Application Priority Data

April 3, 1991 [NL] Netherlands.....9100574
September 4, 1991 [NL] Netherlands.....9101493

Signed and Sealed this

Twenty-first Day of February, 1995

Attest:

Bruce Lehman

BRUCE LEHMAN

Attesting Officer

Commissioner of Patents and Trademarks